US007601247B2

(12) United States Patent
Robinson et al.

(10) Patent No.: US 7,601,247 B2
(45) Date of Patent: Oct. 13, 2009

(54) FALLING BED CATHODE CELL FOR METAL ELECTROWINNING

(75) Inventors: Douglas J. Robinson, Sun Lakes, AZ (US); Stacey A. MacDonald, Phoenix, AZ (US); Davide Scotti, Cinisello Balsamo (IT); Francesco Todaro, Milan (IT)

(73) Assignee: De Nora Elettrodi S.p.A., Milan (IT)

( * ) Notice: Subject to any disclaimer, the term of this patent is extended or adjusted under 35 U.S.C. 154(b) by 843 days.

(21) Appl. No.: 10/561,560

(22) PCT Filed: Jun. 23, 2004

(86) PCT No.: PCT/EP2004/006790

§ 371 (c)(1),
(2), (4) Date: Feb. 3, 2006

(87) PCT Pub. No.: WO2005/001165

PCT Pub. Date: Jan. 6, 2005

(65) Prior Publication Data

US 2007/0102302 A1 May 10, 2007

(30) Foreign Application Priority Data

Jun. 24, 2003 (IT) ..... MI2003A1270

(51) Int. Cl.

| | |
|---|---|
| ***C25C 7/02*** | (2006.01) |
| ***C25C 7/00*** | (2006.01) |
| ***C25C 1/12*** | (2006.01) |
| ***C25C 1/08*** | (2006.01) |
| ***C25C 1/14*** | (2006.01) |
| ***C25C 1/16*** | (2006.01) |
| ***C25C 1/10*** | (2006.01) |

(52) U.S. Cl. ..... 204/237; 204/263; 205/348; 205/572; 205/574; 205/594; 205/587; 205/573; 205/602; 205/610

(58) Field of Classification Search ..... None
See application file for complete search history.

(56) References Cited

U.S. PATENT DOCUMENTS

| | | | | |
|---|---|---|---|---|
| 3,974,049 | A * | 8/1976 | James et al. | 205/348 |
| 4,019,968 | A * | 4/1977 | Spaziante et al. | 205/144 |
| 4,243,498 | A | 1/1981 | Sherwood et al. | |
| 4,272,333 | A | 6/1981 | Scott et al. | |
| 4,425,214 | A * | 1/1984 | Pellegri | 204/254 |

(Continued)

FOREIGN PATENT DOCUMENTS

WO WO 2004/007805 A 1/2004

OTHER PUBLICATIONS

A study of the spouted-bed electrowinning of copper V. Jiricny The Minerals, Metals & Materials Society, 1999.*

(Continued)

*Primary Examiner*—Harry D Wilkins, III
(74) *Attorney, Agent, or Firm*—Charles A. Muserlian

(57) ABSTRACT

A cell (100) for metal electrowinning from metal ion solutions is described, wherein the cathode (1) consists of a falling bed of growing beads; the beads, withdrawn from the lower part of the bed, are recycled to the top section of the cathodic compartment by means of an external vertical duct (3).

15 Claims, 5 Drawing Sheets

U.S. PATENT DOCUMENTS

| | | | | |
|---|---|---|---|---|
| 5,958,210 | A | 9/1999 | Siu et al. | |
| 6,298,996 | B1 * | 10/2001 | Spiegel et al. | 205/754 |
| 6,936,142 | B2 * | 8/2005 | Hradil et al. | 204/222 |
| 7,494,579 | B2 * | 2/2009 | Robinson et al. | 205/348 |
| 2002/0195333 | A1 * | 12/2002 | Hradil et al. | 204/275.1 |
| 2006/0124452 | A1 * | 6/2006 | Robinson et al. | 204/252 |

OTHER PUBLICATIONS

Spouted Bed Electrowinning of Zinc: Part I vol. 28B Feb. 1997 Juan Carlos Salas-Morales Metallurgical & Material Transactions.*

Spouted Bed Electrowinning of Zinc: Part II A. Verma Metallurgical & Material Transactions vol. 28B Feb. 1997.*

* cited by examiner

FALLING BED CATHODE CELL FOR METAL ELECTROWINNING

This application is a 371 of PCT/EP2004/006790 filed Jun. 23, 2004.

BACKGROUND OF THE INVENTION

The recovery of metals from moving bed cells is known in the art as a very attractive technique, albeit still far from actual industrial practice. Moving bed metal deposition has been first described as an improvement of the more general concept of fluidised bed metal deposition (see for instance U.S. Pat. No. 4,141,804) by Scott et al. in U.S. Pat. No. 4,272,333. A bed of metallic beads is levitated by a liquid electrolyte jet until it passes the top edge of a metal cathode, overflowing in a chamber delimited by such cathode and a semi-permeable diaphragm, separating the falling bed from the anode. The falling bed is thus cathodically polarised, and the metal ions in the electrolyte can discharge on the beads causing their growth. The disclosed method allows to feed the beads as small seeds and to discharge them from the cell after reaching the required growth, but has the obvious drawback of being substantially a batch procedure. Moreover, the cell must be operated as a single cell and has no possibility of being effectively stacked in a laminar arrangement, and its productive capacity by unit volume or by unit installation surface is therefore very limited.

A significant improvement of this concept is offered by the disclosure of U.S. Pat. Nos. 5,635,051 and 5,958,210, directed to the electrowinning of zinc. In this case, the cathodic compartment contains a spouted bed generated by the ascending motion of the electrolyte supplied to a draft tube, and split into two annuli in the falling regions, disposed at the two sides of the tube. The anodic and cathodic compartment are separated by means of an ion-permeable barrier, such as an ion-exchange membrane or the like. The anolyte and the catholyte are therefore physically separated and the growing beads are again excluded from the anodic compartment, but the passage of the ion to be deposited from the anodic to the cathodic compartment is allowed. The cell is somehow better than the one disclosed in U.S. Pat. No. 4,272,333 in terms of productive capacity, being quite flat, and even foreseeing the possibility of a parallel arrangement of a plurality of draft tubes and relevant falling bead annuli to increase the size of at least one dimension thereof. Nevertheless, the deposition disclosed therein is still a typical batch process, the depletion of metal ions in the anolyte chamber having to be counteracted with a delicate restoring procedure, in order to maintain a certain stability of the cell conditions.

A substantial progress with respect to the above described technologies is given by the spouted bed cell disclosed in the co-pending Italian Patent Application MI2002A001524, relative to a cell element which can be laminated in a filter-press structure and which is provided with means for the selection and discharge of the product so as to make possible a continuous-type process, also by means of a peculiar separating element consisting of an electrically insulating diaphragm which operates the exclusion of the beads from the cathodic compartment, while allowing the free passage of electrolyte between one compartment and the other and thus remarkably simplifying the overall balance of matter. In this kind of application, the draft tube which establishes the spouted bed of growing beads is again internal to the cathodic compartment, and the above bed still has an annular-type geometry, with the beads disposed in a generally rectangular annulus for each side of the draft tube (case of the tube centred inside the cathodic compartment) or in a single annulus generally disposed along the single free side (case of the tube arranged along a side-wall). Notwithstanding the good functioning of this type of cell, it however leaves some significant problems unresolved: firstly, the draft tube size is limited by the depth of the cathodic chamber. Since for compactness reasons the latter must have a necessarily reduced thickness (20 mm indicatively), the extension of the bead annuli generated by the spouted bed has a consequently limited planar development. Moreover, the draft tube is sometimes subject to local stoppages or other kinds of functioning irregularities, which are not easy to detect and solve, being the same tube incorporated within the cathode shell. The same can be said for the product selection and discharge system, entrusted to internal devices that are difficult to control in case of even partial stoppages. Finally, to maintain a spouted bed with the required characteristics, the draft tube inlet becomes a zone of very high turbulence where the friction phenomena, locally reverberating on the diaphragm, entail remarkable hazards of damaging or rupture.

OBJECTS OF THE INVENTION

It is an object of the present invention to provide a cell for metal electrowinning overcoming the limitations of the prior art.

Under a first aspect, the inventions consists of a cell for electrowinning metal from an electrolyte comprising a falling bed of growing metallic beads, fed through a preferably transparent external vertical duct, crossed by an upward stream of beads and electrolyte.

Under a second aspect, the invention consists of a monopolar or bipolar arrangement of cells having a falling bed cathode of growing metallic beads fed through an external vertical duct.

Under a further aspect, the invention consists of the use of a cell or of a cell arrangement having a falling bed cathode of growing metallic beads for electrowinning a metal selected among copper, tin, manganese, zinc, chromium and cobalt.

DESCRIPTION OF THE INVENTION

The cell of the invention is a substantial evolution of the spouted bed cell disclosed in MI12002A001524; in particular, for the anodic compartment and the separating diaphragm, the same technological solutions disclosed in the aforementioned co-pending patent application can be adopted. Conversely, in the cathodic compartment it is no more present a spouted-type bed, with the previously mentioned problems of turbulence-generated friction and occasional stoppage, but a more ordered falling bed, fed through an external duct which leads the metallic beads dispersed in the electrolyte in correspondence of the top of the same cathodic compartment, where they move under the force of gravity alone. Such an external duct is preferably transparent, so as to allow the control of flow regularity during operation. Whereas the draft tube of the cell of MI2002A001524 had to be preferably made of metal, since it had to withstand part of the cell compression strain besides remarkable mechanical solicitations, the external feeding duct of the cell of the invention may be advantageously built of plastic material. As an additional advantage with respect to MI2002A001524, the need of electrically insulating the internal draft tube is of course eliminated.

According to a preferred embodiment, at least one of the sidewalls of the cathodic compartment is slanted, in order to favour the conveyance of the product toward the outlet.

According to a preferred embodiment, the upward motion within the external feeding duct is established by means of one or more ejectors. As will be clarified by the following description, the ejector to establish the ascending stream within the external feeding duct may be positioned inside the same duct, preferably on the bottom. The ejector may also be positioned on the bottom of the cathodic chamber, preferably outside the deposition zone, so that it does not interfere with the separating diaphragm, or outside the cell, but in fluid communication with the cathodic bed, for instance by means of a slanted junction tube. Various kinds of ejector may be advantageously employed for the purpose; in a preferred embodiment, the ejector may consist of a simple elongated nozzle mounted on a flange, as known in the art. In this case the flange preferably comprises holes or equivalent vents to favour the fluidisation of the particles.

The cell of the invention is thereby characterised by a mixed circulation, partially internal and partially external, with respect to the cells of the prior art; this offers the further advantage of being able to effect the selection of the growing product according to the bead size, and the relevant discharge of the fraction which has reached the required size, making use of external means, easier to control and operate with respect to the systems of equivalent function disclosed in MI2002A001524. As in the cited co-pending patent application, a preferred embodiment of the invention provides the use of a separating diaphragm between the two compartments provided with perforations at least in correspondence of the falling cathodic bed, so as to permit the free circulation of the electrolyte between one compartment and the other while preventing the passage of the growing beads to the anodic compartment. It must be observed anyway as in view of the more effective product control mechanism, it consequently results much more easier to maintain the balance of matter of a continuous process in the cell of the invention; this makes the optional use of a completely impervious diaphragm from the hydraulic standpoint, with the consequent separate circulation of anolyte and catholyte, much less troublesome than in the case of the cell of MI2002A001524. This may be important especially in case particular electrowinning baths are employed, which make the cell operation with non separated anolyte and catholyte impractical: this is for instance the case, potentially of high industrial relevance, given by copper deposition from the relative chloride, as described in the co-pending Italian patent application MI2003A000382.

The cell of the invention may be employed as single cell or preferably as modular element of an array of cells on electrical monopolar or bipolar connection.

The cell is suitable for obtaining metals from electrolytic solutions containing the element to be electrowon in ionic form; in particular, the cell is especially suitable for copper, tin, manganese, zinc, nickel, chromium and cobalt electrowinning.

The best embodiments for practising the invention will be further described resorting to the attached figures, which have a merely exemplary purpose and do not wish to limit the invention itself.

DETAILED DESCRIPTION OF THE INVENTION

Figure 1B:
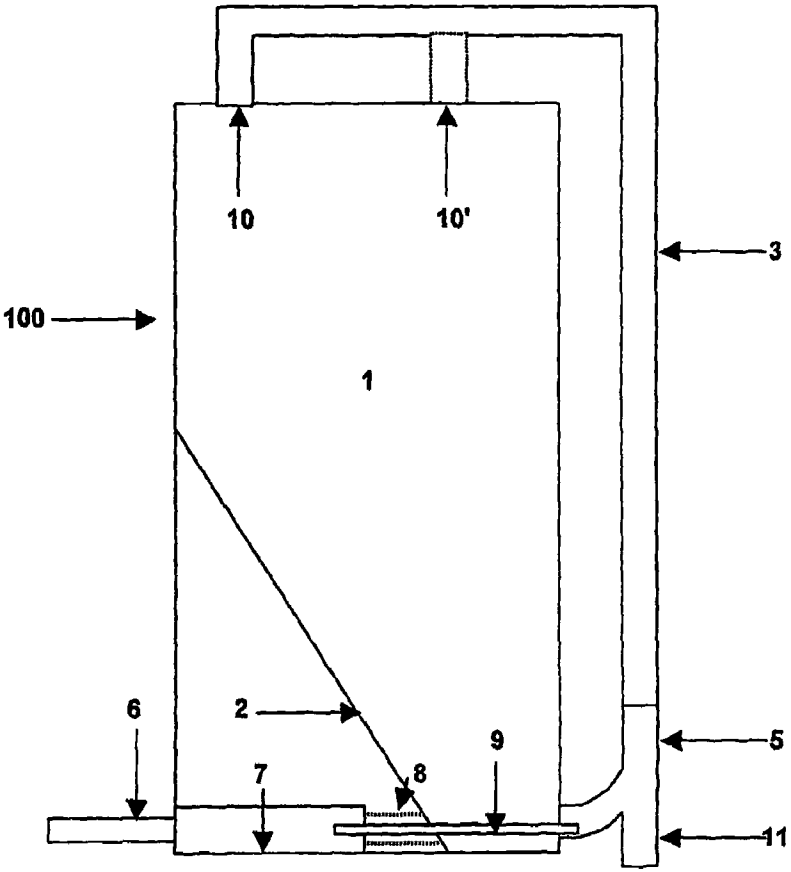
FIGS. 1A and 1B show two embodiments of the invention wherein the optional presence of ejectors for the circulation of electrolyte is limited to the feeding duct of the falling bed.
Figure 1A:
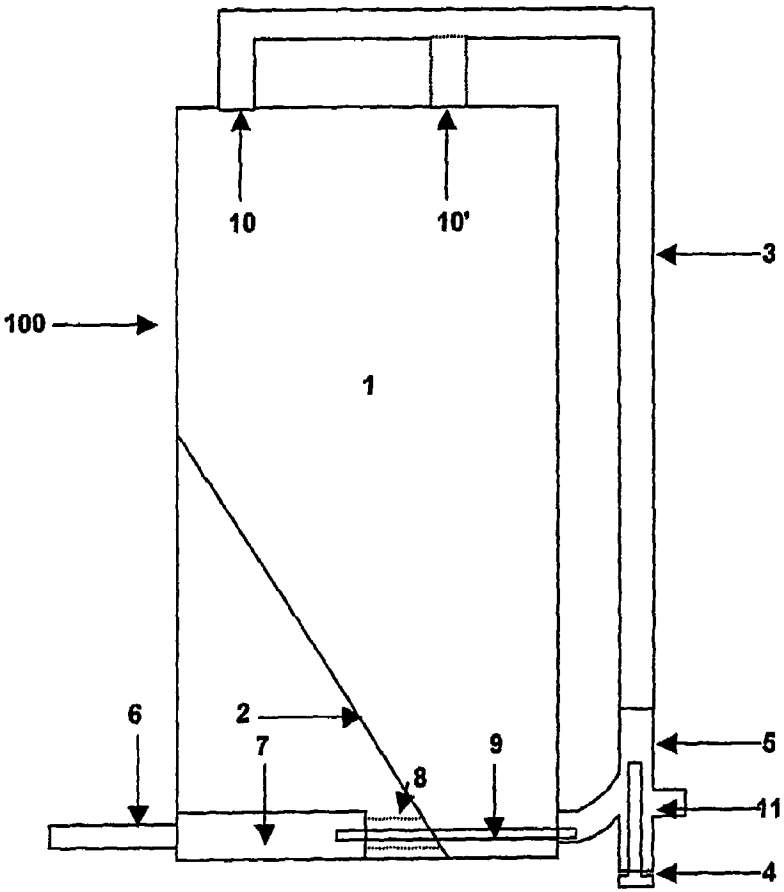

More in detail, FIG. 1A shows an embodiment of the cell of the invention (100) wherein the cathodic compartment (1), filled with a falling bed of growing beads, is delimited by a slanted wall (2) suited to convey the product to the outlet. The falling bed filling the cathodic compartment (1) is fed through the vertical duct (3), preferably transparent, crossed by an upward stream of metallic beads and electrolyte established by an ejector (4) positioned on the bottom of the duct itself, wherein a suitable baffle is present (5) which may consist of a common junction, or even of a T-shaped piece. The solution entering the feed tube (6) hence passes to the chamber (7) coming out of the holes (8) obtained on the slanted wall (2) and of the ejector (9), being fluidised and suctioning the beads toward the baffle (5). Under the action of the ejector (4), the fluid then exerts the push allowing the beads to overcome the difference of level through the duct (3), discharging them through the nozzles (10) and/or (10') placed in the upper zone of the cathodic compartment. The position and the amount of the nozzles (10, 10') is merely indicative, for instance a single nozzle might be present, in a central or lateral position. The solution providing a single nozzle in the position indicated as (10) is preferred in view of the positive effect given by the consequent push of the fluid on the falling bed. The selection according to the bead size and the consequent discharge of a fraction of the product may be effected for instance in the position indicated as (11), for example by means of sifting systems known in the art.

Figure 2B:
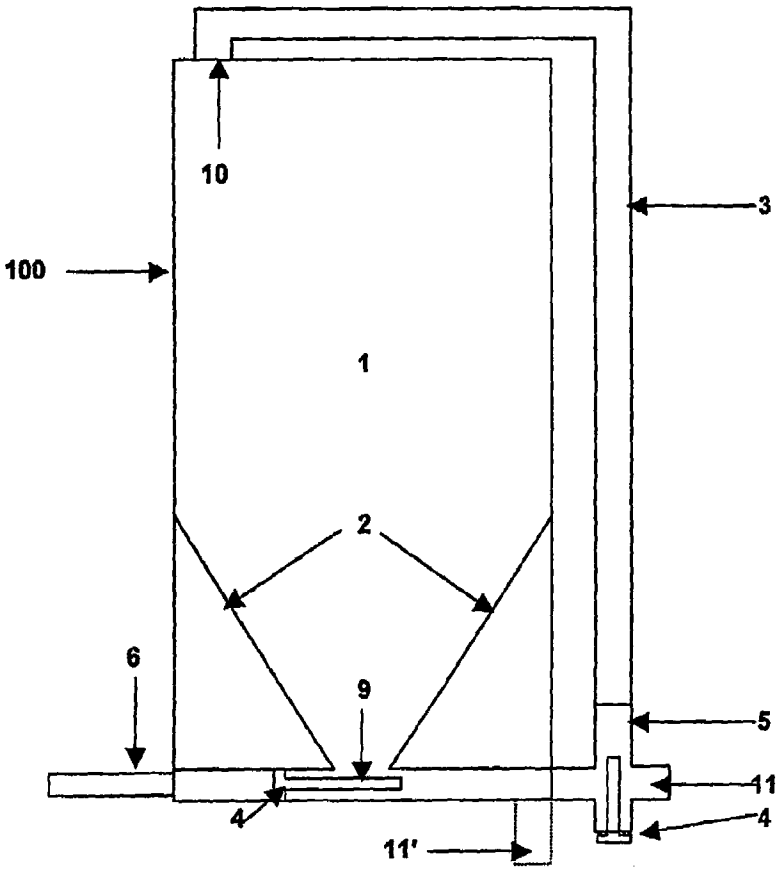
FIGS. 2A and 2B show two embodiments of the invention comprising at least one ejector for the circulation of electrolyte in proximity of the bottom of the cathodic chamber.
Figure 2A:
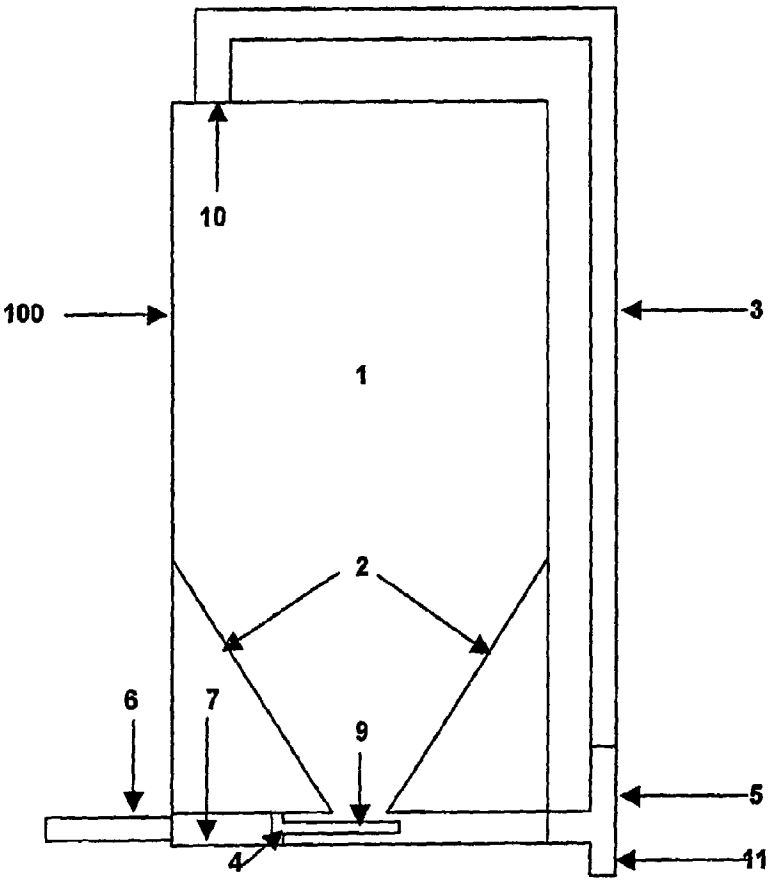

FIG. 1B shows a cell in accordance with the invention constituting an equivalent solution, except for renouncing to the push given by the ejector (4). With respect to the variant in FIG. 1A it is necessary to pump the liquid through the nozzle (9) with a higher prevalence, in order to anyway ensure the circulation of the beads. In FIGS. 2A and 2B two alternative embodiments are shown for the cell of the invention wherein the common elements to the two previous figures are indicated by the same reference numerals. In this case, two slanted sidewalls (2) are provided, disposed on the bottom of the cathodic chamber (1) in a symmetrical position, acting as conveyors of the falling bed. The suction of the beads toward the recirculation duct (3) occurs therefore in the central zone. While in FIG. 2A it is shown a solution providing a single ejector (4) on the bottom of the cathodic chamber (1), in FIG. 2B it is shown a variant with a second ejector (4) inside the vertical duct (3). In the same figure are also shown two possible positions for the system of selection and discharge of the product (11, 11'), which may operate alternatively or jointly.

Figure 3B:
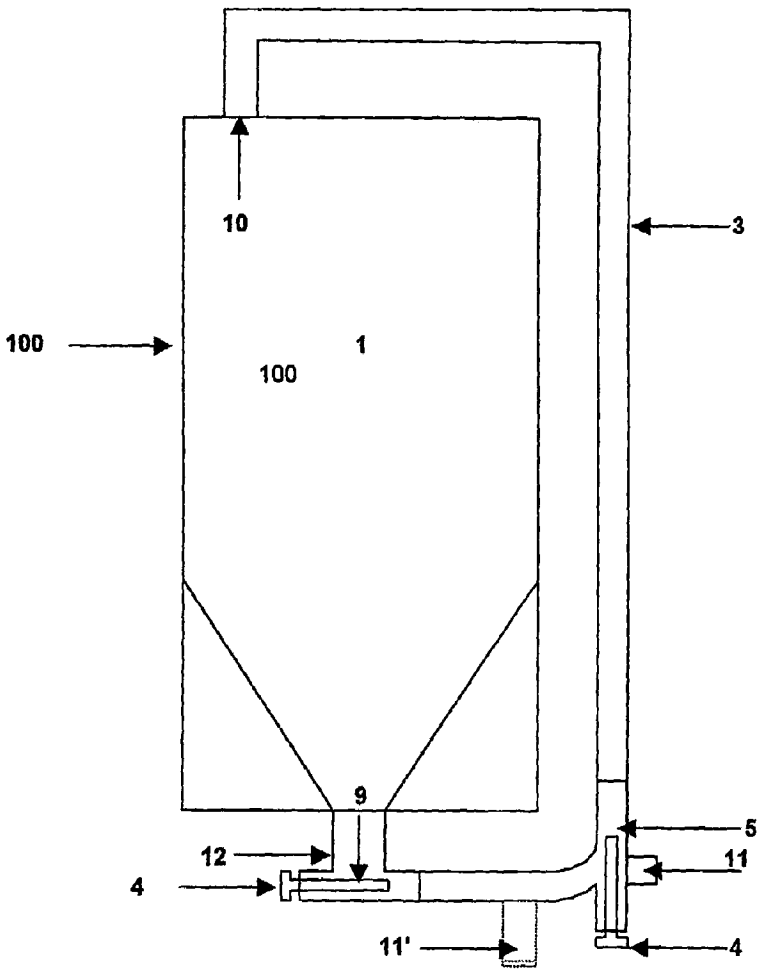
FIGS. 3A and 3B show two embodiments of the invention comprising at least one ejector for the circulation of electrolyte externally to the cathodic chamber, but in fluid communication therewith.
Figure 3A:
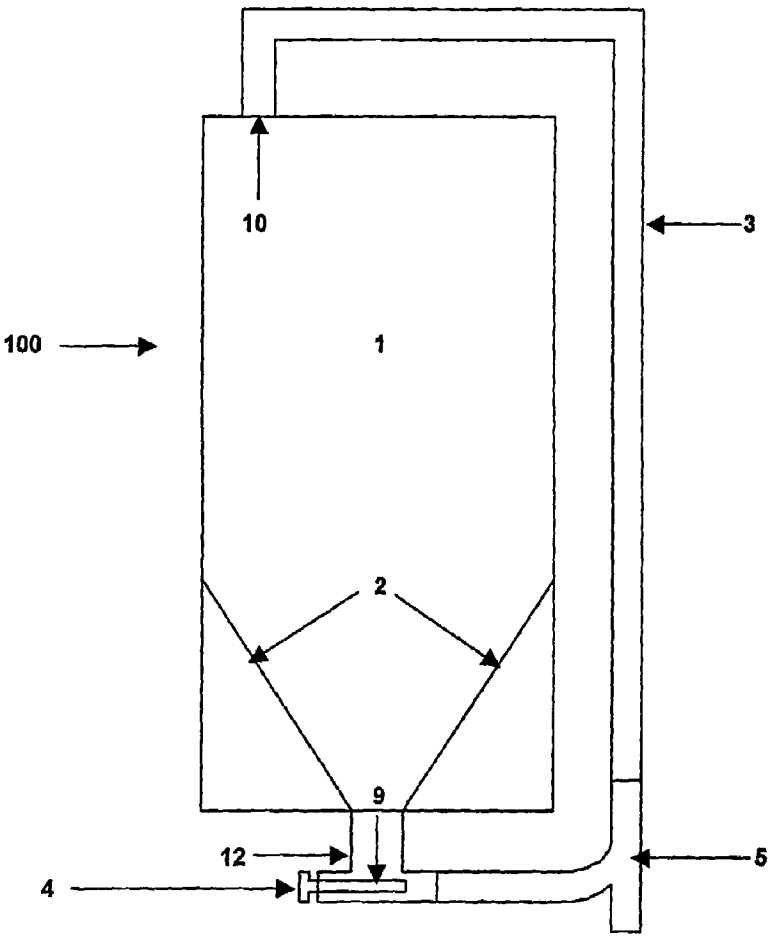

In the embodiments illustrated in FIGS. 3A and 3B the cell is still provided with two slanted sidewalls (2) disposed on the bottom of the cathodic chamber (1) in a symmetrical position, acting as conveyors of the falling bed. Nevertheless, the nozzle (9) and the ejector associated therewith (4) are positioned outside the cell, even though in fluid communication with the falling bed by means of the junction tube (12). Once again, the difference between the two solutions consists of the presence or not of a second ejector (4) positioned on the bottom of the vertical feeding duct (3), present in the embodiment shown in FIG. 3B and non in that of FIG. 3A.

Figure 4B:
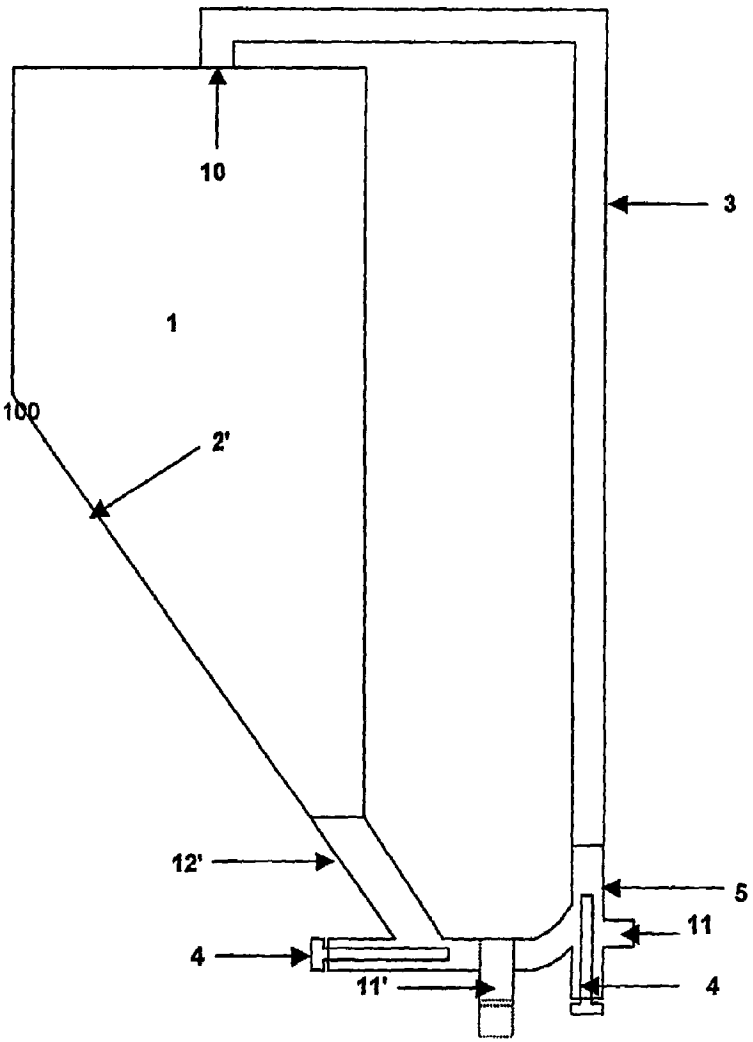
FIGS. 4A and 4B show two embodiments of the invention comprising, externally to the cathodic chamber and in fluid communication therewith, two ejectors for the circulation of electrolyte coupled to a system of collection and selection of the growing beads.
Figure 4A:
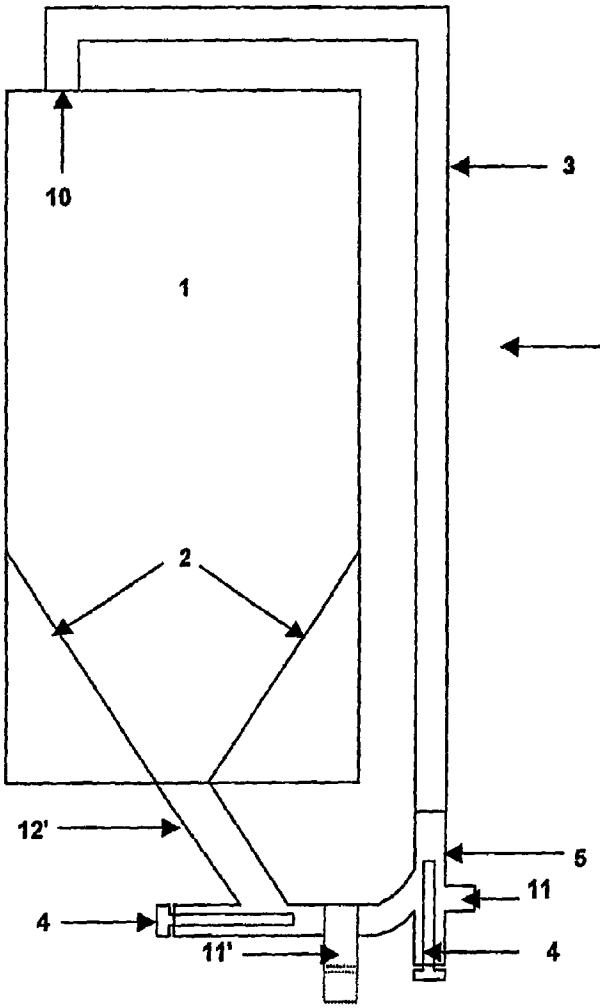
Figure 5A:
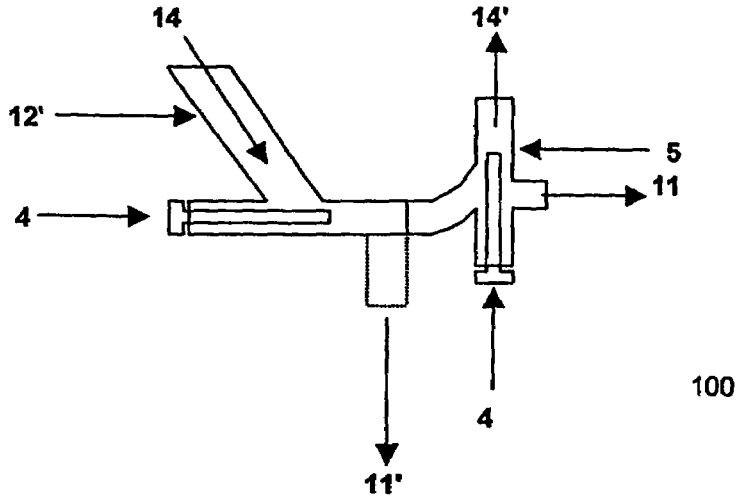
FIG. 5A shows a detail of the two ejectors coupled to the system of collection and selection of the growing beads of FIGS. 4A and 4B.

In FIGS. 4A and 4B only slightly different cell embodiments are shown instead, wherein the junction tube (12') downstream the charging zone is inclined to favour the sliding of the beads and the suction thereof in the recirculation duct. The cell bottom is again provided with a pair of slanted sidewalls (2) (FIG. 4A) or a single slanted bottom (2') (FIG. 4B). The cells shown in FIGS. 4A and 4B also present a device consisting of two ejectors (4) for electrolyte recirculation coupled to a system of collection and selection of the growing beads; such a device is better evidenced in FIG. 5A. The path of the beads and of the electrolyte is evidenced by the arrows (14) and (14'), respectively showing the descending part inside the inclined junction tube (12') and the ascending part inside the feeding vertical duct. Systems known in the art for the selection and collection of the product, for instance sifting systems, may be present in the positions indicated as (11) and (11').

Figure 5B:
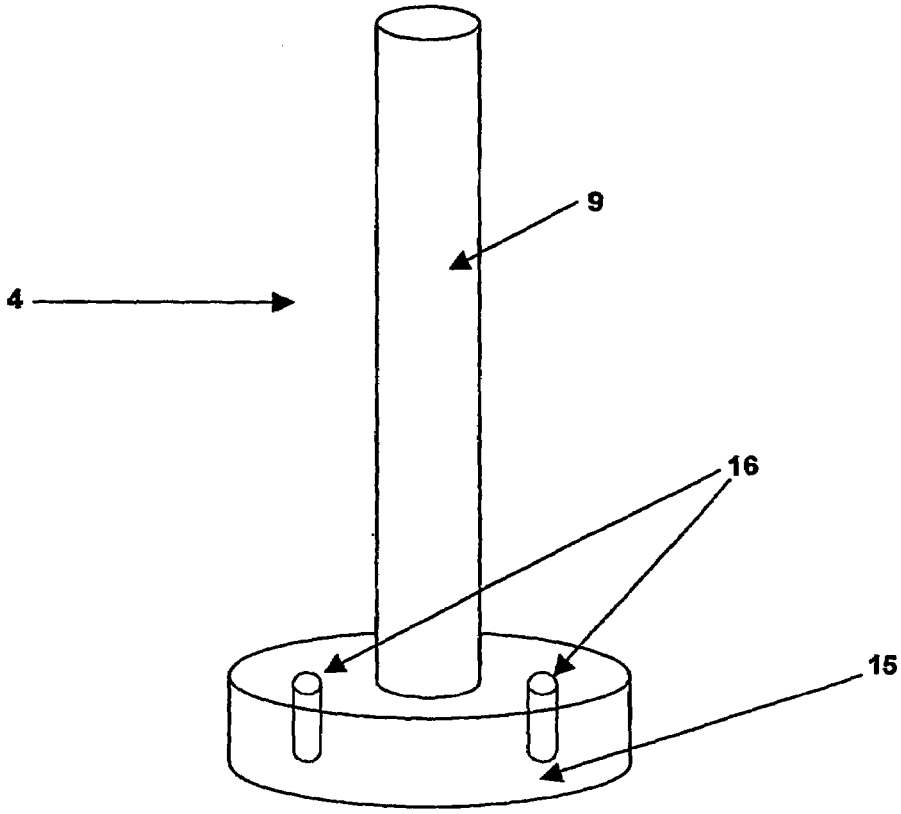
FIG. 5B shows an embodiment of an ejector of the previous figures.

FIG. 5B finally shows an ejector (4) equivalent to those illustrated in the previous figures, comprising a nozzle (9) mounted on a flange (15) provided with outlet openings (16), shown in this case as little holes.

The present description shall not be intended as limiting the invention, which may be practised according to further different embodiments without departing from the scopes thereof, and whose domain is univocally defined by the attached claims. In the description and claims of the present application, the word "comprise" and its variations such as "comprising" and "comprises" are not intended as excluding the presence of other elements or additional components.

The invention claimed is:

1. A cell for metal electrowinning from metal ion solutions comprising a cathodic compartment containing a cathodic falling bed of growing metallic beads separated from the corresponding anodic compartment by an electrically insulating diaphragm, and a generally vertical external duct crossed by an upward stream of said metallic beads and of electrolyte directed to feed said falling bed.

2. The cell of claim 1 wherein said external duct is transparent.

3. The cell of claim 1 wherein said cathodic compartment comprises at least one slanted sidewall.

4. The cell of claim 1 wherein said upward stream is established by means of at least one ejector.

5. The cell of claim 4 wherein said cathodic compartment comprises two slanted sidewalls capable of conveying said metallic beads of said falling bed to the bottom.

6. The cell of claim 4 wherein said at least one ejector is positioned inside said external duct, in the proximity of its base.

7. The cell of claim 4 wherein said at least one ejector is positioned in the proximity of said bottom of said cathodic compartment.

8. The cell of claim 7 comprising a second ejector positioned inside said external duct, in the proximity of the base of said external duct.

9. The cell of claim 4 wherein said at least one ejector is positioned externally to the cell in fluid connection with said bottom of said cathodic compartment.

10. The cell of claim 9 wherein said fluid connection between said bottom of said cathodic compartment and said ejector is achieved by means of a junction tube.

11. The cell of claim 4 wherein said at least one ejector comprises one elongated nozzle mounted on a flange optionally provided with outlet openings suited to go against a duct.

12. The cell of claim 1 comprising an external system of collection and selection of said growing beads.

13. The cell of claim 1 wherein said diaphragm is provided with perforations in correspondence of said cathodic falling bed of growing metallic beads permitting the free circulation of electrolyte between said cathodic compartment and the corresponding anodic compartment while preventing the passage of said metallic beads from said cathodic compartment to said corresponding anodic compartment.

14. An array of cells for metal electrowinning from metal ions comprising a multiplicity of cells of claim 1 in monopolar or bipolar hydraulic connection.

15. In a method of electrowinning a metal selected from the group consisting of copper, tin, manganese, zinc, nickel, chromium and cobalt from an aqueous solution thereof, the improvement comprising effecting the electrowinning in an array of cells of claim 14.

* * * * *